United States Patent [19]

Brunetti et al.

[11] Patent Number: 4,986,050

[45] Date of Patent: Jan. 22, 1991

[54] MODULAR SUPPORT SYSTEM FOR A FILTER-TYPE CEILING GRID

[75] Inventors: Armando Brunetti, W. Paterson; Eric Johnson, Wyckoff; Laura Martz, Morristown, all of N.J.

[73] Assignee: Filtra Corporation, Hawthorne, N.J.

[21] Appl. No.: 396,652

[22] Filed: Aug. 22, 1989

[51] Int. Cl.[5] ..... B01D 46/00

[52] U.S. Cl. ..... 52/488; 52/665; 55/484; 55/355

[58] Field of Search ..... 52/484, 488, 665; 403/174, 295, 363; 55/484, 355, 385

[56] References Cited

U.S. PATENT DOCUMENTS

| | | | |
|---|---|---|---|
| 3,486,311 | 12/1969 | Allan, Jr. . | |
| 3,596,425 | 8/1971 | Kodaras | 52/484 X |
| 3,736,035 | 5/1973 | Brown et al. | 403/295 X |
| 3,785,110 | 1/1974 | Galloway et al. | 52/484 X |
| 3,848,385 | 11/1974 | Thompson | 52/484 X |
| 4,233,044 | 11/1980 | Allan . | |
| 4,545,793 | 10/1985 | Shuler . | |
| 4,555,255 | 11/1985 | Kissel | 55/355 |
| 4,671,811 | 6/1987 | Cadwell et al. | 55/355 |
| 4,683,699 | 8/1987 | Larsson | 52/484 X |
| 4,710,208 | 12/1987 | Ziemer et al. | 55/484 X |
| 4,819,549 | 4/1989 | Gillingham | 55/355 X |

OTHER PUBLICATIONS

Flanders Filters Inc. Bulletin No. 874A, "Channel-Ceil ® Systems Advanced New Designs for Laminar Flow Hepa Filter Ceilings" (1988).

*Primary Examiner*—David A. Scherbel
*Assistant Examiner*—Jerrold D. Johnson
*Attorney, Agent, or Firm*—Fitzpatrick, Cella Harper & Scinto

[57] ABSTRACT

A modular support system for supporting a plurality of high efficiency particulate air filters (HEPA). The modular support system includes a grid of filter support members joined at their intersection by connectors. The support members include first and second side walls and a bottom wall forming a substantially U-shaped channel for receiving a sealant. The first and second side walls extend substantially perpendicular to the bottom wall. The first and second side walls each include a substantially triangular shaped lip extending along their upper edge for releasably securing the support member to an adjacent connector. The connectors include at least two arms extending radially from a center portion. The arms include first and second side walls and a bottom wall forming a substantially U-shaped channel. The dimensions of the U-shaped channel of the arms are such that the arms fit snugly in the U-shaped channels of the corresponding support members. The U-shaped channels of the connectors can be inserted vertically or horizontally into the U-shaped channels of the support members. The triangular lips of the first and second walls of the support member provide a snap fit for releasably securing the two components together without the use of conventional rigid type fastening devices such as bolts, welds, cement, etc.

15 Claims, 5 Drawing Sheets

MODULAR SUPPORT SYSTEM FOR A FILTER-TYPE CEILING GRID

BACKGROUND OF THE INVENTION

The present invention is directed to a ceiling grid for providing filtered air to a work area.

Precision manufacturing and assembly operations require a contaminant free work area which is often referred to as a "clean room." Clean room facilities have been previously developed to control the amount of particulate matter in an environment where precision manufacturing and assembly operations are conducted. Such facilities usually include a plurality of high efficiency particulate air filters (HEPA) supported by a lattice-work. The lattice-work generally is designed to direct the air flowing through the clean room through the filters for subsequent filtering. Therefore, the juncture between the filters and the lattice-work must be air-tight. To accomplish this end, the lattice-work usually includes rectangular support frames each having a central opening for receiving a filter. The rectangular frames include longitudinal and transverse support members and a plurality of cross-shaper connectors. The connectors rigidly join the support members at their intersections by, for example, bolts, welds, cement, etc. The support members include a channel for receiving a sealant which provides the necessary air-tight seal between the filters and the modular support frame. Since the connectors are rigidly secured to the support members these types of lattice-works are significantly more time consuming to assemble. Moreover, these assemblies cannot be readily modified to enlarge or reduce the size of the clean room to accommodate varying needs, while still providing a structurally sound support system.

OBJECTS AND SUMMARY OF THE INVENTION

It is an object of the present invention to provide an improved modular support system for a filter-type ceiling grid.

Another object of the present invention is to provide a modular support system having an air-tight seal around the peripheral edges of the high efficiency particulate air filters, and having a construction that can be readily assembled.

A further object of the present invention is to provide a modular support system, the size of which can be easily varied.

Still another object of the present invention is to provide a modular support system, the components of which are releasably secured to each other.

These and other objects and advantages of the present invention will be readily apparent from the description of the preferred embodiment and the accompanying drawings.

In summary, the present invention is directed to a modular support system for supporting high efficiency particulate air filters. The modular support system includes a plurality of support members and a plurality of connectors for joining the support members at intersections. Each of the support members is provided with means for releasably securing it to a corresponding connector.

DETAILED DESCRIPTION OF THE DRAWINGS

DESCRIPTION OF THE PREFERRED EMBODIMENT

Figure 1:
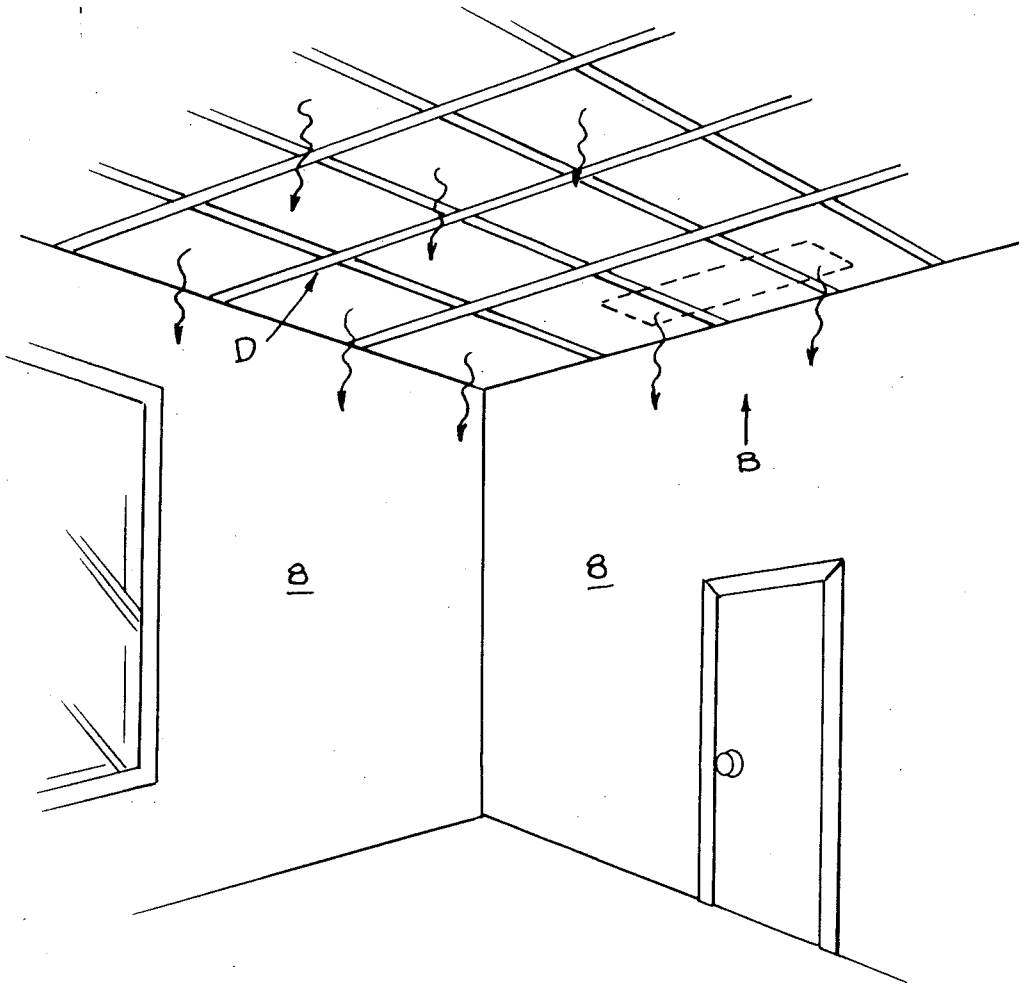
FIG. 1 is a fragmentary perspective view of a clean room illustrating the modular support system of the present invention.
Figure 2:
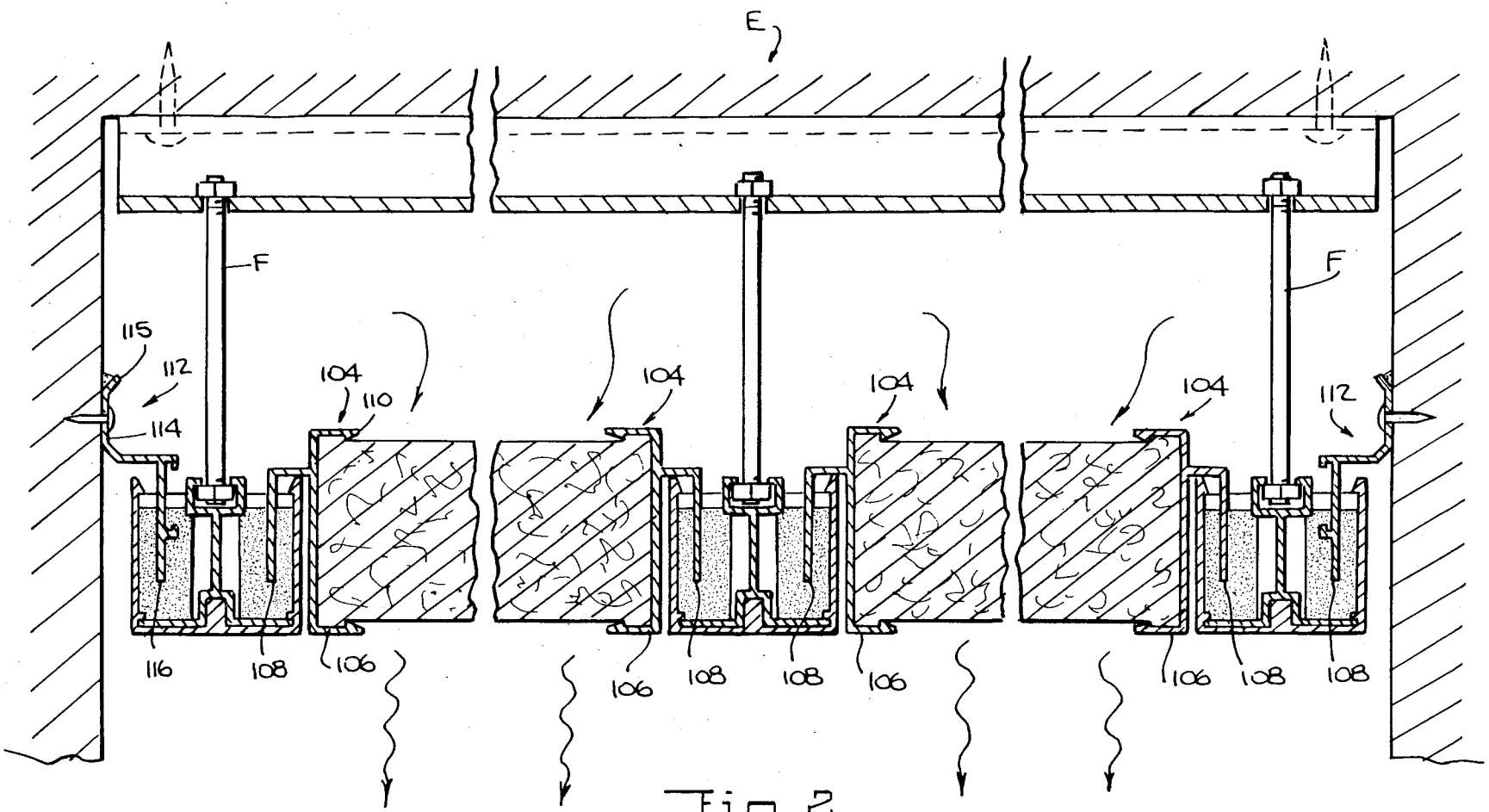
FIG. 2 is a fragmentary cross-sectional view of the modular support system of the present invention suspended from a ceiling by suspension rods.
Figure 3:
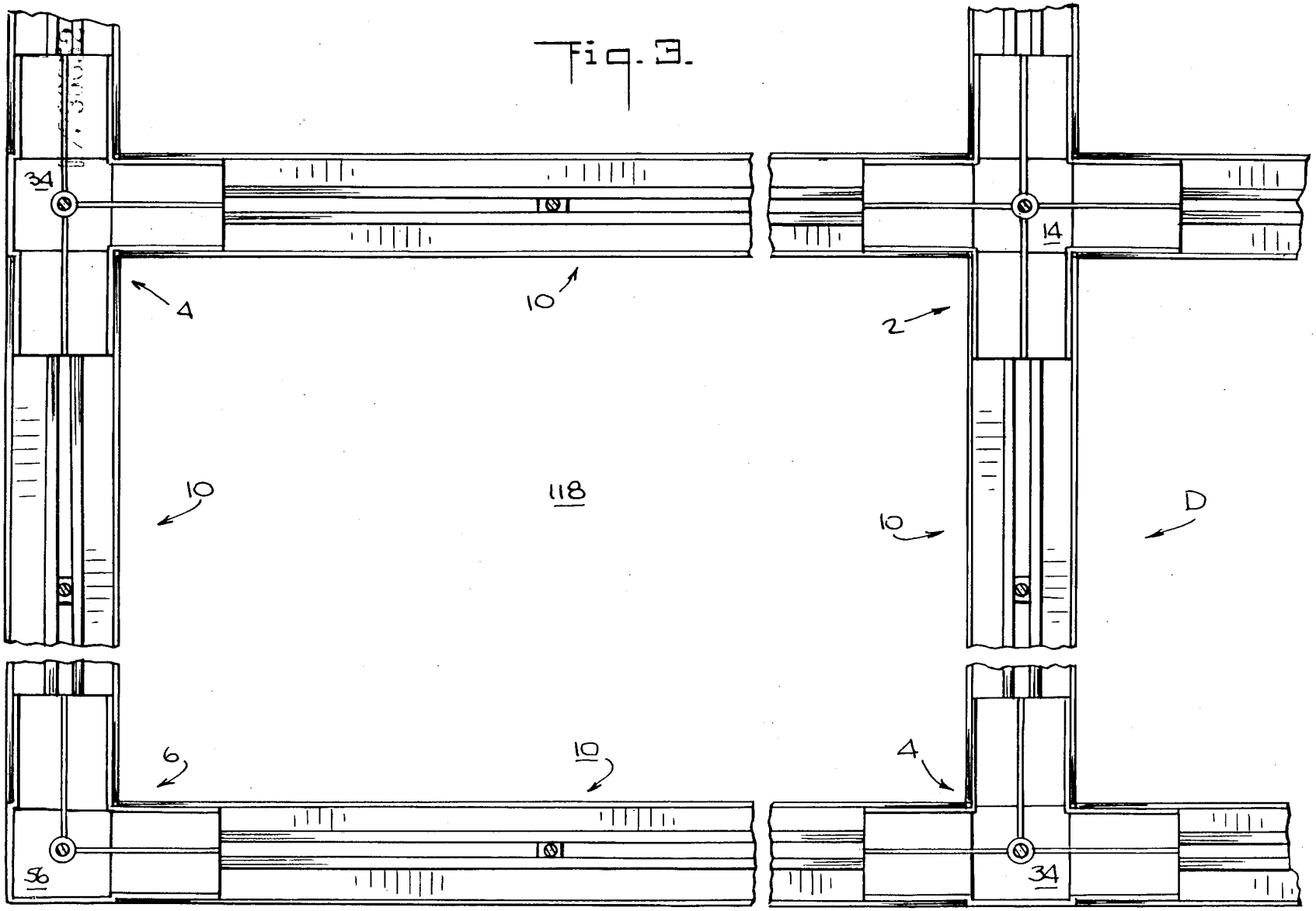
FIG. 3 is a fragmentary plan view of the modular support system in accordance with the present invention.

The preferred embodiment will be described with reference to FIGS. 1 to 9. FIG. 1 depicts a clean room A which includes a filter grid B comprised of a plurality of high efficiency particulate air filters C supported by a modular support system D. The modular support system D is suspended from a ceiling E by suspension rods F, as shown in FIG. 2. The manner in which the modular support system D is suspended from ceiling E will be more fully described below in conjunction with FIGS. 7 and 8. The modular support system D, as illustrated in FIG. 3, includes a plurality of cross-shaped connectors 2 (only one of which is shown), T-shaped connectors 4, L-shaped connectors 6 (only one of which is shown), support members 10, adjustable support members 92, filter receptacle 104 and wall runner 112. These components will now be described in detail. Referring to FIG. 3, the L-shaped connectors 6 are employed in the corners of the clean room A and the T-shaped connectors are used along the side walls 8 removed from the corners thereof. Further, the cross-shaped connectors 2 are located at positions removed from the side walls 8 of the clean room A. The L-shaped connectors 6 join two adjacent support members 10 while the T-shaped connectors 4 and the cross-shaped connectors 2 join three and four adjacent support members 10, respectively. Although only one L-shaped connector 6 is illustrated in FIG. 3, generally four L-shaped connectors 6 are used in a rectangular shaped clean room A, i.e. a clean room having four corners. The number of T-shaped connectors 4 and cross-shaped connectors 2 will depend upon the size of the clean room A and the desired spacing between the intersections of the support members 10 and the connectors 2, 4 and 6.

The connectors 2, 4 and 6 will now be described in greater detail with reference to FIGS. 3 to 6. The cross-shaped connector 2 depicted in FIG. 4 includes four arms 12 extending radially an equal distance from a substantially square center section 14 (shown in FIG. 3). Adjacent arms 12 form right angles with each other. Each of the arms 12 includes a left side wall 16, a right side wall 18 and a bottom wall 20. Left and right side walls 16 and 18 extend perpendicular to the bottom wall 20. Further, the left and right side walls 16 and 18, where they are joined to the bottom wall 20 each have a L-shaped recess 22 formed therein which extends the length of the arms 12.

Figure 4:
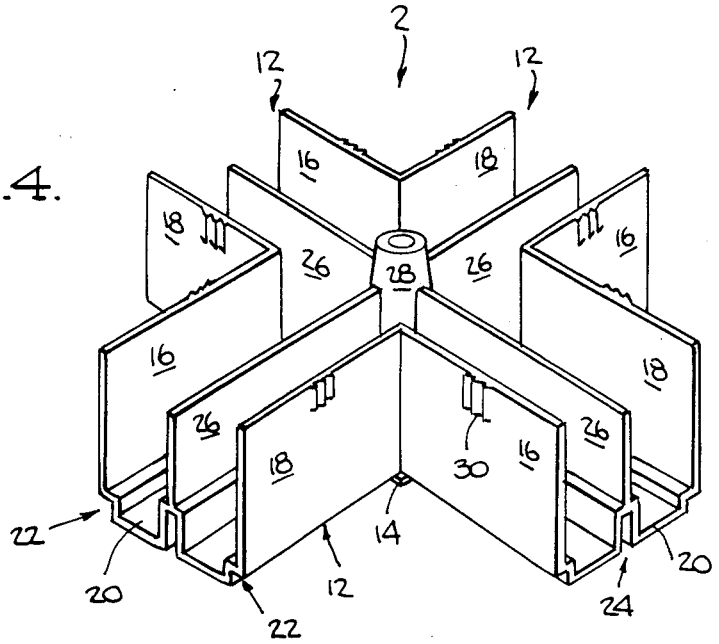
FIG. 4 is a perspective view of a cross-shaped connector formed in accordance with the present invention.

The bottom wall 20 has a substantially U-shaped outer recess 24 formed in the center thereof. The recess 24 extends from the open end of the arms 12 to the center section 14. A center plate 26 extends along the recess 24 and the center section 14. The center plate 26 extends parallel to left and right side walls 16 and 18. Further, the top surface of the center plate 26 is offset inwardly from the top surface of the side walls 16 and 18. Conical element 28 joins the center plates 26 of the four arms 12. The side walls 16 and 18 each include teeth 30 extending from the outer surface thereof. Although FIG. 4 depicts three teeth 30, it will be readily appreciated that the number of teeth may be varied. The center section 14 extends parallel to and is offset downwardly from the bottom walls 20 and the arms 12.

Figure 5:
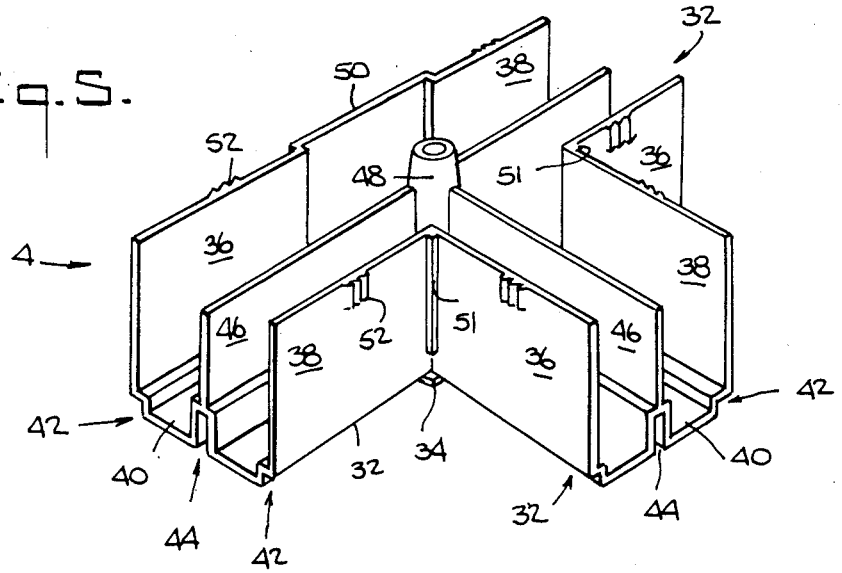
FIG. 5 is a perspective view of a T-shaped connector formed in accordance with the present invention.

Referring to FIGS. 3 and 5, the T-shaped connector 4 includes three arms 32 extending radially an equal distance from a center section 34 (shown in FIG. 3). Each of the arms 32 includes a left side wall 36, a right side wall 38 and a bottom wall 40. The side walls 36 and 38 extend perpendicular to the bottom wall 40. Further, a L-shaped recess 42 is formed in each of the side walls 36 and 38 and extends along the bottom wall 40. A substantially U-shaped outer recess 44 is formed in the center of the bottom wall 40 and extends from the open end of arms 32 to the center section 34. A center plate 46 extends along the recess 44 and a portion of the center section 34. The center plate 46 extends parallel to left and right side walls 36 and 38. Further, the top surface of the center plate 46 is offset inwardly from the top surface of side walls 36 and 38. The three center plates 46 are joined by conical element 48. A wall 50 extends from the center section 34 and parallel to the side walls 36 and 38 of arms 32. The wall 50 is offset outwardly from the adjacent side walls 36 and 38. Each of the side walls 36 and 38 of the arms 32 include teeth 52. The center section 34 is offset downwardly from the bottom walls 40 and extends parallel thereto.

The connector 4 is provided with a stepped surface 51 extending between adjacent arms 32. The stepped surface 51 prevents misalignment of the ends of adjacent support members 10. Although the surface 51 is shown in connection with the T-shaped connector 4, it will be readily appreciated that connectors 2 and 6 could be similarly modified.

Figure 6:
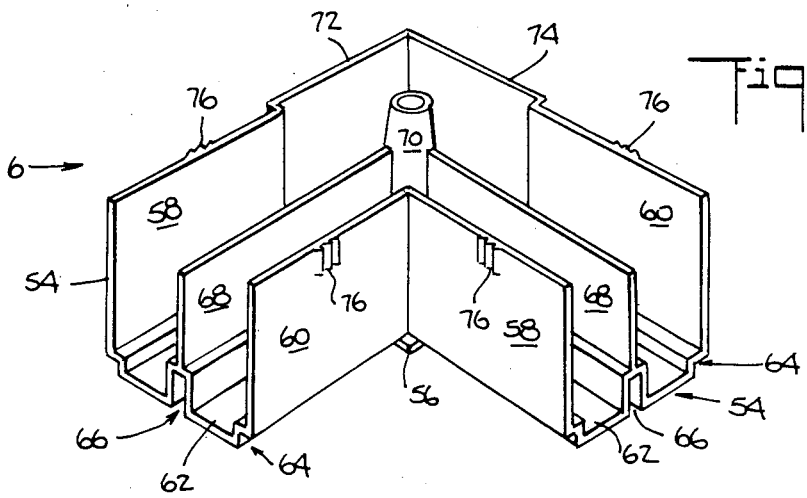
FIG. 6 is a perspective view of a L-shaped connector formed in accordance with the present invention.

The L-shaped connector 6, as shown in FIGS. 3 and 6, includes a pair of arms 54 extending radially an equal distance from center section 56 (see FIG. 3). Each of the arms 54 has a left side wall 58, a right side wall 60 and a bottom wall 62. The side walls 58 and 60 extend perpendicular to bottom wall 62 and have L-shaped recesses 64 formed therein which extend along the bottom wall 62. A substantially U-shaped recess 66 is formed in the center of bottom walls 60 and extends from the open end of arms 54 to the center section 56. A center plate 68 extends inwardly along the recess 66 and a portion of the center section 56. The pair of plates 68 are joined by a conical element 70. The conical element 70 is positioned in the center of the center section 56. Walls 72 and 74 extend from the center section 56 and form a right angle. The walls 72 and 74 are offset outwardly from adjacent side walls 58 and 60, respectively. Further, the center section 56 extends parallel to and is offset downwardly from the bottom wall 62 of each of the arms 54. The side walls 58 and 60 have teeth 76 formed on the outer surface thereof.

Figure 9:
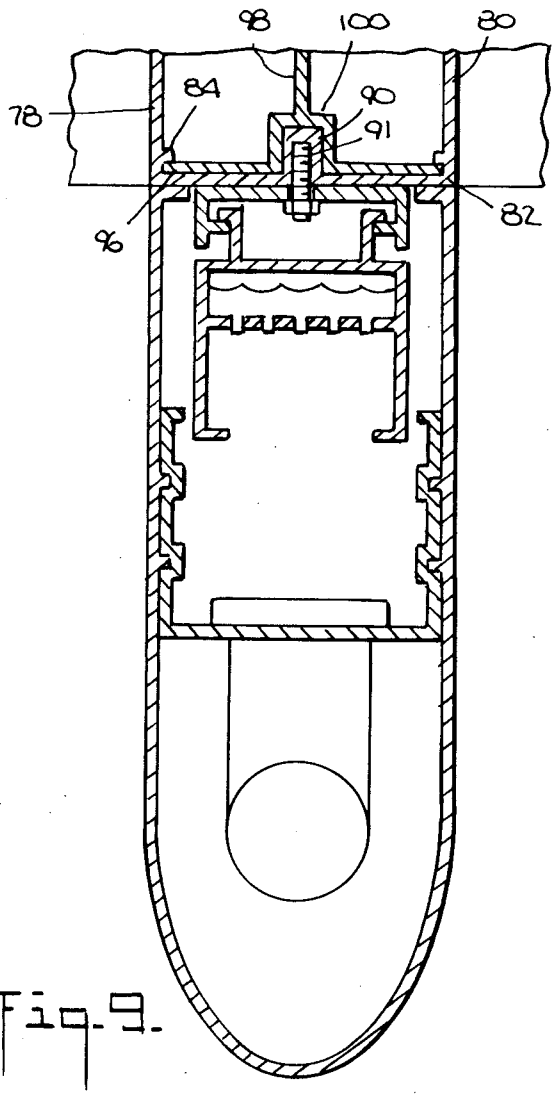
FIG. 9 is a cross-sectional view of the modular support system of the present invention illustrating an attachment device for securing a teardrop light to the modular support system.
Figures 7, 8:
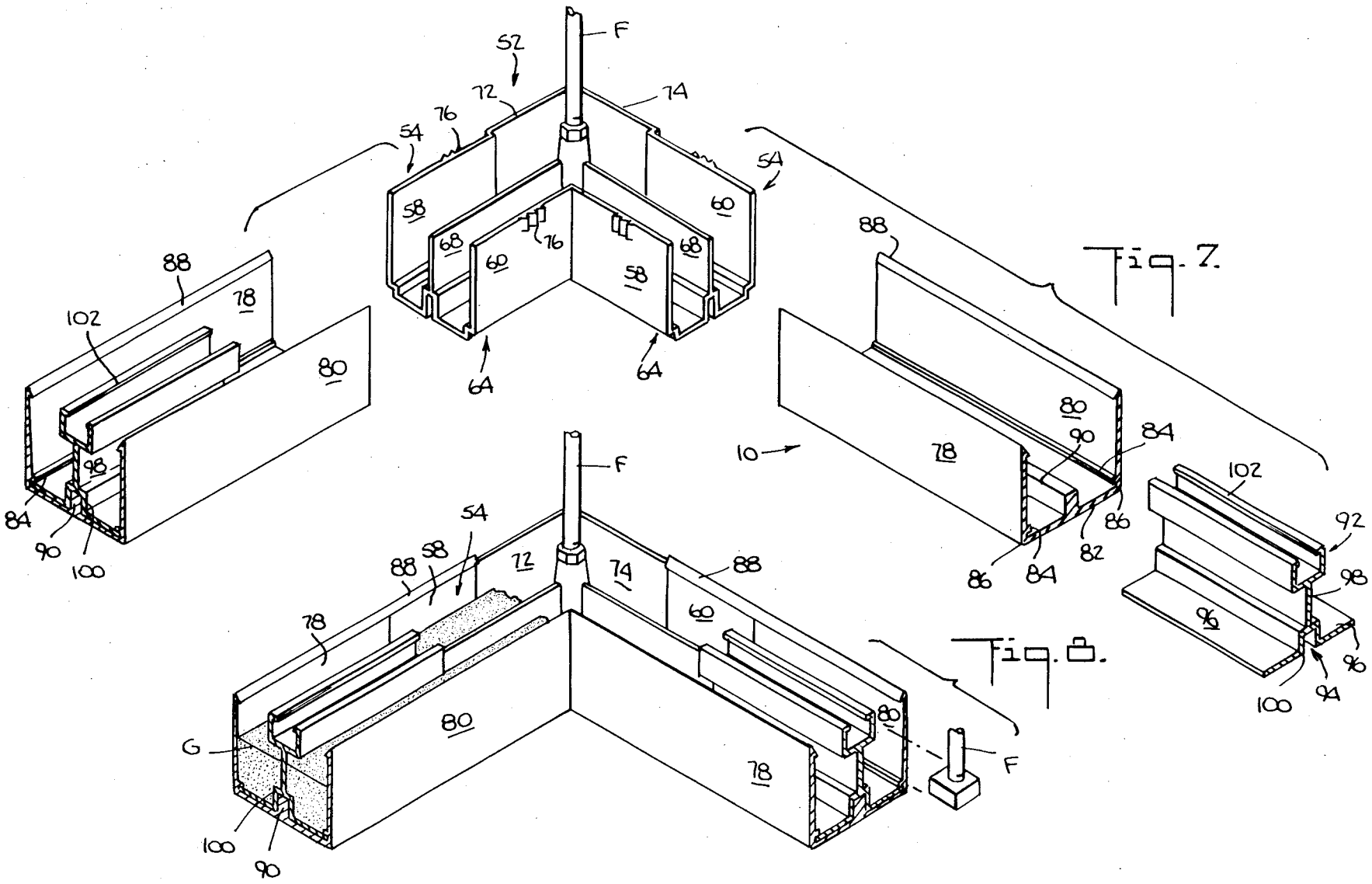
FIG. 7 is an exploded view of a section of the modular support system of the present invention.
FIG. 8 is a perspective view of a section of the modular support system illustrated in FIG. 7.

Referring to FIGS. 3, 7 and 8, the support members 10 will now be described. The support members 10 include a left side wall 78, a right side wall 80, and a bottom wall 82. The side walls 78 and 80 extend perpendicular to the bottom wall 82 and thus, the three walls form a substantially U-shaped channel. Side walls 78 and 80 each have a rectangularly shaped protrusion 84 positioned adjacent the bottom wall 82. The protrusions 84 extend along the length of the side walls 78 and 80 and form grooves 86 with the bottom wall 82. The side walls 78 and 80 further include a triangular lip 88 extending along the top edge thereof. A raised element 90 extends along the center of the bottom wall 82. The support members 10 are open at each end and the top thereof. Referring to FIG. 9, a threaded bore 91 can be formed in element 90 for receiving, for example, a teardrop light. The bore 91 extends through the bottom wall 82 positioned directly under the raised element 90. Further, the bore 91 extends into only a portion of the raised element 90.

An adjustable support 92, as seen in FIGS. 7 and 8, includes a center portion 94 and a pair of legs 96. The center portion 94 is comprised of a vertical plate 98, a U-shaped channel 100 and a C-shaped channel 102. The channels 102 and 100 are positioned on the top and bottom surfaces of the vertical plate 98, respectively.

Referring to FIG. 2, a filter receptacle 104 includes a U-shaped clamp portion 106 and a runner 108. The ends of the clamp portion 106 have a triangular lip 110 for securing the corresponding HEPA filter C to the receptacle 104. A receptacle 104 is associated with each side of the filter C. A wall runner 112 includes a substantially planar section 114, an inclined section 115 and a leg 116.

ASSEMBLY OF THE MODULAR SUPPORT SYSTEM

Hereinafter the interrelationship of the foregoing components of the modular support system D will be described. A corner section of the modular support system D, partially assembled, is depicted in FIG. 3. A L-shaped connector 6, a pair of T-shaped connectors 4, and a cross-shaped connector 2 join four support members 10 to form a rectangularly shaped opening 118. The connection between the support members 10 and the connectors 2, 4 and 6 will be described with reference to FIGS. 7 and 8. Although FIGS. 7 and 8 specifically illustrate the connection between a pair of support members 10 and a L-shaped connector 6, the support members 10 are secured to connectors 2 and 4 in a similar manner.

The support members 10 can either be positioned below the arms 54 and vertically displaced relative thereto to cause them to snap onto the connector, or they can be positioned in longitudinal alignment therewith and moved in a horizontal plane relative thereto to cause them to slide into an assembled state. The former assembly step is preferred where the working area is confined to a small area. As seen in FIG. 8, the support arms 54 are located on the inside the support members 10 such that element 90 is received in recess 60. Further, the protrusions 84 are received in the corresponding L-shaped recesses 64. The bottom wall 62 of the L-shaped connector 6 rests on the bottom wall 82 of the support member 10. The left and right side walls 58 and 60 abut the outer surfaces of the left and right side walls 78 and 80 of the support member 10, respectively. The triangular lips 88 of the left and right side walls 78 and 80 rest on the top surfaces of the left and right side walls 58 and 60, respectively. The triangular lips 88 provide a snap connection between the support members 10 and the L-shaped connector 6. Further, the teeth 76 prevent relative movement in the longitudinal direction between the side walls of the support member 10 and the side walls of the corresponding connector 52. As previously stated the center section 56 of the L-shaped connector 52 extends parallel to and is offset downwardly from the bottom walls 62 of the arms 54. This offset is equal to the thickness of the bottom wall 82 of support members 10. Accordingly, the outer faces of the pair of bottom walls 82 of the support members 10 and the outer face of center section 56 of the corresponding L-shaped connector 6 lie in the same horizontal plane. Also, walls 72 and 74 are outwardly offset from side walls 58 and 60, respectively a distance equal to the thickness of the corresponding side walls 78 and 80. Accordingly, the exterior surface of the side walls 78 and 80 lie in the same vertical plane as the exterior surfaces of walls 72 and 74, respectively.

Support members 10 are secured to T-shaped connectors 4 and cross-shaped connectors 2 in a similar manner. Regarding the T-shaped connectors 4, the wall 50 extending from the center section 34 is offset outwardly from left and right side walls 36 and 38 of the corresponding arms 34, a distance equal to the thickness of the side walls 78 and 80 of the corresponding support members 10. Also, the center sections 14 of the connector 2 and 4 are offset from the bottom walls 20 and 40, respectively a distance equal to the thickness of the bottom walls 82 of the corresponding support members 10. The conical elements 28, 48 and 70 of the connectors 2, 4 and 6, respectively are threaded bores (not shown) on the upper faces thereof for securing the corresponding connectors to suspension rods F. In this manner, the modular support system is suspended from ceiling E. Alternatively or in addition thereto the adjustable support 92 can be positioned in the U-shaped channel of the support members 10 for receiving the suspension rod F. More specifically, legs 94 and 96 are inserted into grooves 86 while substantially U-shaped recess 100 receives element 90. The C-shaped channel 102 receives the suspension rod F, as shown in FIG. 8. The adjustable member 92 is adapted to slide in the substantially U-shaped channel of support members 10 so that the point at which the support members 10 are connected to the suspension rods F can be readily varied.

The horizontal portion of the runners 108 of the filter receptacles 104, as shown in FIG. 2, rest on the upper surface of the triangular lips 88 while the vertical portion extends into the corresponding U-shaped channel of the support members 10. In this manner, the filters C are supported by the modular support system D.

Wall runners 112 are secured at one longitudinal edge to a corresponding side wall 8 of the clean room A by a rivet or other conventional fastening devices and the other edge thereof extends into the corresponding U-shaped channel of the support members 10.

A silicone dielectric gel G is provided in the U-shaped channels of the support members 10 and the connectors 2, 4 and 6. The depth of the gel G, as shown in FIG. 2, rises above the lower portions of the runners 104 and 108. Further, the gel G is also applied between an upwardly inclined portion 115 of the wall runner 112 and the side wall 8 of the clean room A. Accordingly, an air-tight seal is achieved between the filters F and the modular support system D. Furthermore, an airtight seal is formed between the side walls 8 of the clean room A and the modular support system D.

In the preferred embodiment, the support members 10 are formed by extrusion and the connectors 2, 4 and 6 are formed by casting.

While a preferred embodiment of the present invention has been described above, it will be readily appreciated by the artisan that the scope of the appended claims are not limited thereto.

What is claimed:

1. A support member for a modular support system for supporting a plurality of filters, the modular support system including a plurality of connectors for joining adjacent horizontally disposed support members, each of the connectors including at least two arms extending radially from a center section, each of the arms includes first and second side walls, said support member, comprising:

upwardly open channel means for receiving a sealant, said channel means including at least first and second side walls;

first and second end portions, at least one of said first and second end portions being adapted to be operably associated with an arm of a connector; and at least one of said first and second walls including retaining means adjacent said at least one of said first and second end portions for releasably securing said support member to the connector, said retaining means including a lip extending inwardly of said channel means and longitudinally along an upper edge of the at least one of said first and second walls of said channel means for providing a snap fit between said channel means and the corresponding arm of the connector, wherein said lip is adapted to permit said channel means to be secured to the corresponding arm of the connector when positioned below the arm by moving the channel means vertically relative thereto and when secured to the connector said lip rests on a top surface of a corresponding wall of the arm of the connector.

2. A support member as in claim 1, wherein said lip is so disposed on the at least one of said first and second walls to permit said channel means to be secured to the connector by aligning said channel means with the connector and moving said channel means longitudinally relative to the connector.

3. A support member as in claim 1, wherein a said lip is formed on each of said first and second walls of said channel means.

4. A support member as in claim 1, wherein a cross-section of said lip is substantially triangular in shape.

5. A support member as in claim 1, wherein said channel means includes a bottom wall having a raised section extending along at least a portion of said bottom wall and substantially parallel to said first and second walls, and wherein a bore is formed in an outer surface of said bottom wall for receiving a fixture.

6. A support member as in claim 5, wherein said bore extends through said bottom wall of said channel means and through only a portion of said raised section.

7. A support member as in claim 1, and further including an adjustable securing means slidably associated with said channel means for securing said channel means to a suspension element.

8. A support member as in claim 7, wherein said channel means includes first and second grooves formed respectively in said side walls, said first and second grooves being adapted to receive first and second flanges of said adjustable securing means.

9. A support connector for a modular support system for supporting a plurality of filter panels, the modular support system including a plurality of connectors for joining adjacent support members, each of the support members having a substantially U-shaped channel means for receiving a sealant, the support connector, comprising:

at least first and second channel shaped arms extending radially from a center portion, said first and second arms are adapted to receive respective support members thereon;

said at least first and second arms each including first and second side walls;

at least one of said first and second side arms having a plurality of teeth formed in an outer face thereof for engaging an inner face of the U-shaped channel means, for preventing relative movement in a longitudinal direction between said at least one of said first and second arms and the support member, wherein said connector arms each have a bottom wall connecting said side walls and being perpendicular thereto, and said center portion extends substantially parallel to and is offset downwardly from said bottom walls of said first and second arms.

10. A support connector for a modular support system for supporting a plurality of filter panels, the modular support system including a plurality of connectors for joining adjacent support members, each of the support members having a substantially U-shaped channel means for receiving a sealant, the support connector, comprising:

at least first and second channel shaped arms extending radially from a center portion, said first and second arms are adapted to receive respective support members thereon;

said at least first and second arms each including first and second side walls;

at least one of said first and second side arms having a plurality of teeth formed in an outer face thereof for engaging an inner face of the U-shaped channel means, for preventing relative movement in a longitudinal direction between said at least one of said first and second arms and the support member, wherein said center portion includes a bottom plate, extending substantially perpendicular to said first and second walls of said first and second arms, and at least one side wall extending substantially parallel to said first and second walls of said first and second arms, said at least one side wall is offset outwardly from the adjacent walls of said first and second arms.

11. A support connector for a modular support system for supporting a plurality of filter panels, the modular support system including a plurality of connectors for joining adjacent support members, each of the support members having a substantially U-shaped channel means for receiving a sealant, the support connector, comprising:

at least first and second channel shaped arms extending radially from a center portion, said first and second arms are adapted to receive respective support members thereon;

said at least first and second arms each including first and second side walls;

at least one of said first and second side arms having a plurality of teeth formed in an outer face thereof for engaging an inner face of the U-shaped channel means, for preventing relative movement in a longitudinal direction between said at least one of said first and second arms and the support member, wherein said at least first and second arms include a bottom wall extending perpendicular to said first and second walls and disposed therebetween, said system being disposed horizontally with said connector side walls including upper surfaces for providing a snap fit with a support member by vertical movement relative thereto.

12. A support connector as in claim 11, wherein said bottom walls of said first and second arms each include a substantially U-shaped recess formed in an outer surface thereof, said first and second arms include a center plate extending from the corresponding U-shaped recess.

13. A support apparatus as in claim 12, wherein said center plates of said first and second arms are joined by a conical member and extend substantially parallel to said first and second walls of corresponding first and second arms.

14. A modular support system for supporting a plurality of high efficiency air filters, comprising:

a plurality of support members;

a plurality of connectors for joining adjacent support members;

said plurality of support members including channel means for receiving a sealant, said channel means having at least first and second walls and first and second end portions;

said plurality of connectors include at least first and second arms adapted to receive corresponding end portions of said channel means thereon, said first and second arms including first and second walls; and at least one of said connector arms and one of said plurality of support members include retaining means for releasably securing said one connector arm to said one support member, such that at least a portion of said first and second walls of said one connector arm provides a snap fit with said first and second walls of said one channel means, wherein said first and second walls of said channel means are adapted to permit said plurality of support members to be secured to the said connectors when positioned below said corresponding connector arm by moving said channel means vertically relative thereto and when secured to said connector, said retaining means rests on a top surface of a corresponding wall of connector said arm.

15. A modular support system as in claim 14, wherein said retaining means includes a lip formed on each of said first and second walls of said channel means for providing a snap fit between one of said plurality of connectors and said at least one of said plurality of support members.

* * * * *